US005165973A

United States Patent [19]

Kojima et al.

[11] Patent Number: 5,165,973

[45] Date of Patent: Nov. 24, 1992

[54] INK JET RECORDING SHEET

[75] Inventors: Yutaka Kojima; Takashi Omori, both of Tokyo, Japan

[73] Assignee: Jujo Paper Co., Ltd., Tokyo, Japan

[21] Appl. No.: 466,629

[22] Filed: Jan. 17, 1990

[30] Foreign Application Priority Data

Jan. 18, 1988 [JP] Japan ..... 1-8993

[51] Int. Cl.[5] ..... B41M 5/00

[52] U.S. Cl. ..... 428/331; 346/135.1; 428/195; 428/341

[58] Field of Search ..... 428/195, 331, 341, 342; 346/135.1

[56] References Cited

FOREIGN PATENT DOCUMENTS 57-107879 7/1982 Japan ..... 428/195

*Primary Examiner*—Pamela R. Schwartz

*Attorney, Agent, or Firm*—Sherman and Shalloway

[57] ABSTRACT

An ink jet recording sheet providing an image by the use of an aqueous ink containing a water-soluble dye comprises a substrate having thereon a specific ink receptive layer. This ink jet recording sheet has excellent properties under maintaining the paper-like figure and feeling of an uncoated sheet.

6 Claims, No Drawings

INK JET RECORDING SHEET

BACKGROUND OF THE INVENTION

1. Field of the Invention

This invention relates to a recording sheet for ink jet printer (hereinafter refered to as ink jet recording sheet).

2. Prior Art

In recent years, the demand for color printer is increased. Particularly, an ink jet printer, one of the non-impact recording systems, is highly increased since a comparatively rapid color recording is possible for its simplified system, since the noise is less than impact printers such as dot-printer, etc., and since the use in offices is easy, and the like.

In ink jet recording sheets, the use of synthetic amorphous silica has been proposed in various forms for the purpose of improving the color density, ink absorbency, ink drying ability, feathering of ink and flowing out of ink. For example, there are disclosed an ink jet recording sheet coated with a non-colloidal silica powder in Japanese Laid-Open Patent Application No. 55-51583, an ink jet recording sheet having a base paper coated with a mixture of a fine silicic acid and a water-soluble resin in Japanese Laid-Open Patent Application No. 56-148583, and an ink jet recording sheet obtained by at least double applications of the same coating color consisting of both synthetic silica and aqueous binder in total coating-amount of at least 10 g/m$^2$ in Japanese Laid-Open Patent Application No. 57-107879.

As synthetic amorphous silica, there are silica manufactured by a wet precipitation process, by a wet gel process or by a humed process, i.e. a process of hydrolysing silicium tetrachloride in a oxyhydrogen flame. In conventional ink jet recording papers, silica manufactured by a wet precipitation process or by a wet gel process is mainly used, and it is disclosed in the above Laid-Open Patent Applications.

The use of silica manufactured by a humed process is disclosed in Laid-Open Patent Application 60-204390, which describes that an ink receptive layer comprises as the feature a synthetic ultra-fine silica manufactured by a vapor phase process. However, this Patent Application practically discloses a method for coating a ultra-fine silica on an ink receptive layer which is obtained by coating a synthetic amorphous silica in a coating amount of at least 10 g/m$^2$ on a substrate, and it discloses a method for coating a mixture of an ultra-fine silica and a silica manufactured by a precipitation process in a certain mixed-ratio on a substrate in a coating amount of 15 g/m$^2$. In any cases, this Laid-Open Patent Application discloses a coating amount of at least 10 g/m$^2$. Accordingly, the technology in Japanese Laid-Open Patent Application No. 60-204390 is substantially equal to the technology disclosed in Japanese Laid-Open Patent Application Nos. 55-51583, 56-148583, 57-107879 and the like.

That is, the purpose of the above Japanese Laid-Open Patent Publications consists in the preparation of an ink jet recording sheet having both a good recording density and an excellent ink absorbency by applying a coating material of 10–20 g/m$^2$ on a substrate.

As methods for preparing an ink jet recording sheet having an improved water-resistance, Japanese Laid-Open Patent Application No. 56-84992 discloses the coating of a polycation-polyelectiolyte on the surface of an ink receptive layer, and Japanese Laid-Open Patent Application No. 59-20696 discloses the use of an ink receptive layer containing polydimethyldiallyl ammonium chloride.

As the method for preparing a recording sheet having both a good light resistance and an excellent image-light resistance, there is wellknown various ink receptive layers containing each of metal oxide, UV-absorber, oxidation inhibitor, etc.

Japanese Laid-Open Patent Application No. 58-177390 discloses that an ink jet recording sheet suitable for an ink jet printer of electric field control type is obtained by coating an electric conductive agent of quaternary ammonium type on the surface of an ink receptive layer containing both a synthetic silica and an aqueous binder for the purpose of providing a normal printability, wherein the sheet is independent of environmental humiditic changes by means of preventing the electrostatic chargeability.

As described above, the subject of the hitherto ink jet recording sheets was to improve various properties, that is, the color density, the ink-absorbency, drying ability, feathering, flowing out, the water resistance and light resistance of a image and a recording sheet (printability of a recording sheet), and the like. Recently, a discoloration and a fading caused by indoor and outdoor gases have become a great problem.

As gases causing a discoloration or a fading, there are $NO_x$-gas, sulfur dioxide gas, etc., in exhaust gases or factory smokes; ozone generated from many copying machines; smokes of cigarets; and the like.

Ozone is generated more and more, since many small or medium copying machines have been used increasingly in offices owing to the miniaturization and the simplification of many copying machines through the Office Automations. However, the discoloration or the fading caused by indoor and outdoor gases (oxidizing gases) forms a particularly great problem. It is well-known that some of oxidizing gases cause an oxidizing excitation of acidic dye-molecules in an aqueous ink for an ink jet recording.

For the preparation of a sheet having both an appropriate recording density and a sufficient ink absorbency in an full color ink jet recording with high quality and density, it is required that an ink-receptive layer is provided in accordance with the maximum amount of ejected inks in an unit printing area. In this case, the conventional technique of coating a conventional synthetic amorphous silica such as a silica manufactured by a wet process or by a humed process, usually requires a coating amount of at least 10 g/m$^2$ on a substrate.

In coating a filler such as silica etc. on a fiber-like substrate in an amount of circa 10 g/m$^2$, the fibers are covered with powdered fillers completely, so that the paper-like figure and feeling are lost in a paper-base substrate. And owing to the less bulk density, the fine silica requires more binder than other fillers.

Since many vacant spaces in the coating layer are filled with the binder, the coating amount must be further increased for providing a good ink-absorbency, so that the paper-like figure and feeling are increasingly lost. In a small amount of binder, the recording sheet has a good ink absorbency, but it exhibits as the defects a weak surface strength and the troubles of paper-powder generation, of clogging the oriffices by the powders and the like, so that it is not used as a usual recording sheet.

The synthetic silica, which is used as a catalyst in oxidizing-reactions, has an excellent function as a catalyst. Accordingly, in the conventional recording sheets coated with a large amount of synthetic silica for improving both a recording density and an ink absorbency, there are following defects: With an increased amount of synthetic silica, the fading of the image is strengthen by oxidizing gases generated in the catalytic action, and the paper-like figure and feeling are further decreased.

Moreover, metal oxide, UV-absorber, oxidation-inhibitator, polycation-polyelectrolyte. etc., which are used for improving both a light resistance of a recording sheet and that of an image, have no ability of preventing a fading caused by oxidizing gases. And some of the above agents increase the fading.

As described above, there is unknown a method for preventing the fading of the ink jet recording-image by oxidizing gases, etc., under maintaining both a good recording density and a high ink absorbency with excellent paper-like figure and feeling.

Further, it has been found that such a method is not achieved by extending the conventional techniques.

SUMMARY OF THE INVENTION

It is the general object of this invention to provide an ink jet recording sheet which has an uniform image quality, a high recording density, a good full color printability, an excellent ability preventing the fading of an image by oxidizing gases, etc., a superior presetability of image and a good light resistance of image, under maintaining the paper-like figure and feeling of an uncoated sheet.

The above object is achieved by a substrate having thereon an ink receptive layer comprising both an ultra-fine anhydrous silica and a cationic polymer, wherein the ink receptive layer can be obtained by means of a coating, and impregnating, and/or the like.

DETAILED DESCRIPTION OF THE INVENTION

The ultra-fine anhydrous silica of this invention is an amorphous silica having a high $SiO_2$-content and no internal surface, in form of an aggregate of spherical particles having a means primary particle size of 7–40 mμ.

Usually, silica easily produces hydrogen-bonds owing to the presence of silanol groups and indicates a thixotropic property in a polar solvent such as water. The silica manufactured by a wet process have many silanol groups on the internal surfaces of particles, while the ultra-fine anhydrous silica of this invention has many silanol groups on the outer surfaces of particles owing to the absence of internal surfaces. Accordingly, the ultra-fine anhydrous silica easily forms between particles the hydrogen-bonds based on silanol groups and causes a prominent viscosity-increase in a high slurry consistency, so that it is not applicable as a coating material in combination with a water soluble resin as a binder of the conventional wet-process silica.

It has been found that this ultra-fine anhydrous silica can be employed as a coating material in combination with a cationic polymer in accordance with this invention.

The method of mixing both this ultra-fine anhydrous silica and the cationic polymer is not particularly limited, and is, for example, as follows:

(1) The ultra-fine silica is dissolved in water or an aqueous solution of binder, and the cationic polymer is added to the solution containing the ultra-fine silica.

(2) The ultra-fine silica is dissolved in an aqueous solution of the cationic polymer, if liquid, and then the obtained solution is dissolved in water or an aqueous solution of binder.

(3) The ultra-fine silica and the cationic polymer are dispersed in water or an aqueous solution of binder simultaneously.

Usually, the mixing is made by using an agitator.

The dispersing of a mixture the ultra-fine anhydrous silica and the cationic polymer forms a considerably uniform aggregate, which gives a lower slurry viscosity than other coating material without a cationic polymer. Moreover, this dispersed mixture is easily coated, wherein the obtained coating layer has a bulky structure.

The ultra-fine anhydrous silica has the specific surface of a wide range measured by BET-method and can be used in this invention, independing of the specific surface values.

However, with a decreased BET-specific surface, the color density is reduced. With an increased BET-specific surface, silica forms a large aggregate and non-uniform voids in which ink permeates deeply, so that the color density is decreased. Accordingly, it is desirable to select an appropriate specific surface, taking the desired quality of recording sheet and the production-property of coating material into consideration.

The cationic polymer of this invention include, for example, polyethylene-imine, polydimethyldiallyl ammonium chloride, polyalkylene-polyamine dicyandiamide ammonium condensate, polyvinylpyridinium halide, polymers of (meth)acryloyl oxyalkyl quaternary ammonium salt, polymers of (meth)acrylamide alkyl quaternary ammonium salt, ω-chloro-poly (oxyethylene-polymethylene quaternary ammonium alkylate), polyvinyl benzyl trimethyl ammonium salt, methylglycol chitosan e.g.

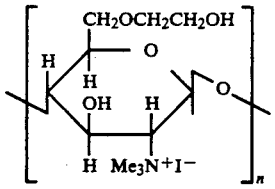

and the like.

Preferably, the cationic polymers of this invention are polydimethyldiallyl ammonium chloride, polymers of (meth)acryloyl oxyalkyl quaternary ammonium salt, polymers of (meth)acrylamide alkyl quaternary ammonium salt, ω-chloro-poly (oxyethylene-polymethylene-alkyl quaternary ammonium salts) and methylglycol chitosan.

In this invention, the mixed ratio of the cationic polymer to the ultra-fine anhydrous silica is not particularly determined depending upon the kind, the molecular weight and the cationic degree of the cationic polymer, the specific surface and particle size of the ultra-fine anhydrous silica, the kind and the amount of the binder or the additive, and the like. From the experimental results, it seems to be suitable to use 0.2–20 weight-parts of the cationic polymer, based on 100 weight-parts of the ultra-fine anhydrous silica and mixed ratio (by weight) of the cationic polymer to the water soluble binder of 1 to 0–2.

Naturally, these amounts are not particularly limited, and must be determined depending upon the experimental results under consideration of the above conditions. The increase of the added cationic polymer provides a decrease in dot optical density, ink absorbency, and resistance to fading of image by oxidizing gases.

The coating material of this invention comprises optionally various water-soluble resins as a binder. These water-soluble resins includes, for example, oxidized starch, cationic starch, polyvinylalcohol, cellulose derivatives such as hydroxyethyl cellulose and carboxymethyl cellulose, polyacryl amide and derevatives thereof, polyvinylpyridine, polyethylene oxide, polyvinylpyrrolidone, casein, gelatin, sodium alginate, polystyrene sulfonate, sodium polyacrylate, hydrolysis product of starch-acrylonitrile graftpolymer, sulfonated chitin, carboxylated chitin, chitosan, and derivatives thereof.

Among these binders, the binders having almost no reactivity with the cationic polymer are preferable.

The ink receptive layer (coating layer) of this invention comprises mainly the ultra-fine anhydrous silica, optionally other fillers for improving a paper-sliding property, a writing suitability and the like. These fillers include, for example, calcium carbonate, clay (activated clay, calcined clay, etc), kaolin, talc, synthetic silica (manufactured by a wet precipitation process or by a wet gel process), alumina, aluminum hydroxide, zinc oxide, calcium silicate, synthetic silicate, titanium dioxide, diatomaceous earth, barium sulfate, satin white, glass powder, organic resin pigment, etc.

The ink receptive layer of this invention comprises optionally chemicals such as surface active agent, etc. for improving printed qualities such as feathering, dot size, etc.

The substrate of this invention must be a good ink absorptive material, for example, a paper having voids of a certain size which is manufactured alone or in mixed state from pulp, regenerated stuff of waste paper, chitin, synthetic fiber, glass fiber, etc.; a sheet having voids of a certain size such as non-woven fabric having suitable voids.

As papers, there are used papers manufactured in no sizing, acidic sizing or neutral sizing.

The substrate of this invention can comprise or coat optionally additives in such amount that the ink absorbency, paper-like figure and feeling are not decreased. These additives include, for example, various fillers and other additives. And the substrate of this invention can be coated by a small amount of e.g. resins and pigments, wherein it is desirable to use the coating amount of at most 10 g/m$^2$ under consideration of paper-like figure and feeling.

In the application of the coating material, there are used, for example, sizing press machine, roll coater, blade coater, air knife coater, bar coater, curtain coater, spray-machine, etc. In the present invention, the substrate surface is coated or impregnated with a mixture containing an ultra-fine anhydrous silica and a cationic polymer, thereby attaining the object of the present invention, that is, obtaining an ink jet recording paper, which has uniform image quality, a high recording density, allows multicolor recording, has reduced discoloration of image with an oxidizing gas, and has storage stability and light fastness of recorded images, while retaining the paper-like figure and feeling of an uncoated paper, such as bond paper and copying paper.

It is considered that the coating material containing a mixture of the cationic polymer and the ultra-fine silica forms an ink-receptive layer, which is bulky and relative uniform.

EXAMPLES

This invention is illustrated in detail below with reference to Examples and Comparative Examples; but this invention is not limited thereto. In Examples, all parts and percentages are by weight.

EXAMPLE 1

100 parts of LBKP (bleached hardwood kraft pulp) having 300 Freeness (CSF) as a pulp stuff, 10 parts of kaolin (kaolinite-group, spherical aggregate, mean primary particle size: 0.1μ, specific weight: 2.2), 0.15 part of fortified rosin sizing agent (Coropal CS, manufactured by Seiko Chemical Co.) and 1 part of aluminum sulfate were mixed. A base sheet having a weight of 63 g/m$^2$ was produced from the mixed stuff by a paper machine.

On the other hand, 100 parts of ultra-fine anhydrous silica (mean primary particle size: 12 μm, BET-specific surface area: 200 m$^2$/g) were dispersed in circa 1264 ml of water. 35.7 parts of 28% aqueous solution of a cationic polymer (polydimethyldiallyl ammonium salts; average molecular weight: circa 12,000) as an additive, and 100 parts of an aqueous solution of polyvinyl alcohol A (saponification value: circa 99%; average polymerization degree: 1700) were added to the dispersed solution to form a coating material of 8% aqueous solution (solid content). The obtained coating material was applied onto the base paper in a coating amount of circa 2 g/m$^2$ (as solid content) by a size press machine. The resultant paper was treated by a supercalender to make the smooth recording surface.

Thus, a recording paper of Example 1 was obtained.

COMPARATIVE EXAMPLE 1

100 parts of a fine silica F manufactured by a wet precipitation process (50% mean particle size: 2.7 μm; BET-specific surface area: 270 m$^2$/g), and 20 parts of an aqueous solution of polyvinyl alcohol A were mixed to produce a coating material of 16% aqueous solution. The produced coating material was applied onto the substrate used in Example 1 in a coating amount of circa 14 g/m$^2$ by an air knife coater.

The resultant paper was treated in the same manner as in Example 1 to obtain a recording sheet of Comparative Example 1.

COMPARATIVE EXAMPLE 2

A recording sheet of Comparative Example 2 was obtained in the same manner as in Comparative Example 2, except for using 62.5 parts of a fine silica G manufactured by a wet gel process (50% mean particle size: 10 μm, BET-specific surface area: 300 m$^2$/g) and 37.5 parts of the ultra-fine silica instead of the fine silica manufactured by a wet precipitation process of Comparative Example 1.

COMPARATIVE EXAMPLES 3 and 4

Recording sheets of Comparative Examples 3 and 4 were obtained in the same manner as in Example 1, except for using fine powdered silica G manufactured by a wet precipitation process or using silica H manufactured by a wet gel process instead of the ultra-fine silica as a filler of the coating material of Example 1.

TABLE 1

| Sample | | Example 1 | Comparative Example 1 | Comparative Example 2 | Comparative Example 3 | Comparative Example 4 | Comparative Example 5 |
|---|---|---|---|---|---|---|---|
| Ink receptive layer | Ultra-fine silica A | 100 | | 37.5 | | | 100 |
| | Fine silica F (by wet precipitation process) | | 100 | | 100 | | |
| | Fine silica G (by wet preciptation process) | | | 62.5 | | | |
| | Fine silica H (by wet gel process) | | | | | 100 | |
| | Polyvinyl alcohol A | 10 | 20 | 20.0 | 10 | 10 | 10 |
| | Cationic polymer K | 10 | | | 10 | 10 | 5 |
| Coating amount g/m$^2$ | | 2.2 | 14.0 | 14.4 | 2.1 | 2.1 | 2.5 |
| Substrate | | Non-coated paper | Non-coated paper | Non-coated paper | Non-coated paper | Non-coated paper | Comparative Example 1 |
| Recording properties | Density of dots | 5.42 | 5.55 | 5.31 | 5.10 | 4.91 | 6.12 |
| | Ozone-resistance % | 8.8 | 24.7 | 19.0 | 17.5 | 16.5 | 40.5 |
| Paper property | Surface strength | A | B | B | C | C | C |

*Coated paper

COMPARATIVE EXAMPLE 5

2.5 g/m$^2$ of the coating material used in Example 1 were applied onto the recording sheet of Comparative Example 1 to obtain a recording sheet of Comparative Example 5.

The test results of Example 1 and Comparative Examples 1–5 are shown in Table 1.

As seen in Table 1, the recording sheet of Example 1 exhibits a good dot image density, a little fading from the view of an ozone-resistance, a high surface strength in spite of a very small amount of the coating material. Further, this sheet has paper-like figure and feeling owing to a slight coating amount. For these reasons, this sheet is very desirable as a ink jet recording sheet.

On the contrary, the recording sheet of Comparative Example 1 as a conventional recording sheet exhibits a bad fading, and is inferior in paper-like figure and feeling owing to a large amount of the coating materials.

The recording sheet of Comparative Example 2 is inferior in a fading, paper-like figure and feeling, since it contains circa 30% of an ultra-fine anhydrous silica, based on a filler, but no cationic polymer.

Further, the combined use of a conventional silica manufactured by a wet process provides a bad fading and a weak surface strength even in a slight coating amount and in the combined use of a cationic polymer, as shown in Comparative Examples 3 and 4.

The recording sheet of Comparative Example 5 was obtained by applying a coating material of this invention onto a coat-type recording sheet of Comparative Example 1. This recording sheet is inferior in paper-like figure and feeling, and exhibits a weak surface strength and a bad fading. Accordingly, this sheet is not useful as a recording sheet.

EXAMPLES 2, 3 and 4, and COMPARATIVE EXAMPLE 6 an ultra-fine anhydrous silica, a water-soluble binder and a cationic polymer were mixed in the ratios as shown in Table 2 to produce a coating material. The coating material was applied onto the base paper used in Example 1 in an coating amount of circa 2 g/m$^2$ by a meyer bar.

The resultant paper was treated in the same manner as Example 1 to obtain recording sheets of Examples 2, 3 and 4 and Comparative Example 6.

As can be seen from Table 2 of test results, the recording sheet of this invention exhibit a high dot-image density, a little fading, an excellent surface strength and an excellent paper-like figure inspite of a slight coating amount of circa 2 g/m$^2$.

On the other hand, the recording sheet of Comparative Example 6 containing no cationic polymer exhibits a weak surface strength, whereby the ultra-fine anhydrous silica is not fixed on the surface of a substrate and a dusting occurs. This sheet is disadvantageous in its production and usage.

TABLE 2

| Sample | | Example 2 | Example 3 | Example 1 | Example 4 | Comparative Example 6 |
|---|---|---|---|---|---|---|
| Ink receptive layer | Ultra-fine silica A | 100 | 100 | 100 | 100 | 100 |
| | Polyvinyl alcohol A | 10 | 10 | 10 | 10 | 10 |
| | Cationic polymer K | 3 | 5 | 10 | 30 | 0 |
| Coating amount g/m$^2$ | | 2.1 | 2.0 | 2.2 | 2.2 | 2.2 |
| Recording properties | Density of dots | 5.40 | 5.35 | 5.42 | 5.06 | 4.69 |
| | Ozone-resistance % | 5.0 | 6.1 | 8.8 | 9.7 | 5.7 |
| Paper property | Surface strength | A | A | A | A | C |

EXAMPLES 5, 6, 7 AND 8

The recording sheets of Examples 5, 6, 7 and 8 were prepared in the same manner as in Example 3 except that the ultra-fine anhydrous silica B (mean primary particle size: 18 μm, BET-specific surface: 130 m$^2$/g), the ultra-fine anhydrous silica C (mean primary particle size: 16 μm, BET-specific surface: 130 $m^2/g$), the ultra-fine anhydrous silica D (mean primary particle size: 7 μm, BET-specific surface: 380 $m^2/g$) and the ultra-fine anhydrous silica E (ultra-fine silica having a mean primary particle size of 30 μm and a BET-specific surface of 80 $m^2/g$+circa 1% $Al_2O_3$) were used respectively in spite of the ultra-fine anhydrous silica A.

As seen from the Table 3 of these test results, various ultra-fine anhydrous silicas are suitable for this invention independent of specific surface values.

TABLE 3

| | Sample | Example 5 | Example 6 | Example 3 | Example 7 | Example 8 |
|---|---|---|---|---|---|---|
| Ink receptive layer | Ultra-fine silica A | | | 100 | | |
| | Ultra-fine silica B | 100 | | | | |
| | Ultra-fine silica C | | 100 | | | |
| | Ultra-fine silica D | | | | 100 | |
| | Ultra-fine silica E | | | | | 100 |
| | Polyvinyl alcohol A | 10 | 10 | 10 | 10 | 10 |
| | Cationic polymer K | 5 | 5 | 5 | 5 | 5 |
| Coating amount $g/m^2$ | | 2.0 | 2.0 | 2.0 | 1.9 | 2.5 |
| Recording properties | Density of dots | 5.35 | 5.48 | 5.35 | 5.24 | 5.00 |
| | Ozone-resistance % | 4.1 | 5.7 | 6.1 | 7.4 | 4.5 |
| Paper property | Surface strength | A | A | A | A | A |

EXAMPLES 9, 10 AND 11

The recording sheets of Examples 9, 10 and 11 were obtained in the same manner as in Example 1 except that a coating amount of 1 $g/m^2$, 3 $g/m^2$ or 7 $g/m^2$ (solid content) was used instead of a coating amount of 2 $g/m^2$.

From Table 4 of these test results, the recording sheets of this invention can be obtained by adjusting a mixing ratio of binder to cationic polymer or of ultra-fine anhydrous silica to cationic polymer, even in a coating amount of less than 10 $g/m^2$, that is, in the coating range for obtaining a paper-like figure

TABLE 4

| | Sample | Example 9 | Example 3 | Example 10 | Example 11 |
|---|---|---|---|---|---|
| Ink receptive layer | Ultra-fine silica A | 100 | 100 | 100 | 100 |
| | Polyvinyl alcohol A | 10 | 10 | 10 | 10 |
| | Cationic polymer K | 3 | 5 | 5 | 3 |
| Coating amount $g/m^2$ | | 1.2 | 2.0 | 3.4 | 6.6 |
| Recording properties | Density of dots | 5.22 | 5.35 | 5.84 | 6.50 |
| | Ozone-resistance % | 4.3 | 6.1 | 7.2 | 9.2 |
| Paper property | Surface strength | A | A | B | B |

COMPARATIVE EXAMPLES 12, 13 AND 14

(1) 100 parts of LBKP having a freeness of 300 ml were used as a pulp for the substrate. 15 parts of a filler (calcite-group precipitated calcium carbonate, spindle shape, 50% mean particle size: 4.1 μm, BET-specific surface area: 5 $m^2/g$), 1 part of cationic starch and 0.2 part of a sizing agent (alkylene ketene dimer, concentration: 15.5%, viscosity: 80 c.p.) were added thereto. A sheet was manufactured by using a paper-making machine. Further, a substrate (1) weighting 64 $g/m^2$ was manufactured by coating a 8% aqueous solution of oxidized starch in a coating amount of 1.5 $g/m^2$ on the obtained sheet.

(2) 100 parts of LBKP having a freeness of 350 ml were used as a pulp for the substrate. 10 parts of kaolin (filler) (kaolinite-group, spherical aggregate, mean primary particle size: 0.1μ, specific gravity: 2.2), 0.15 part of fortified rosin sizing agent (Coropal CS, manufactured by Seiko Kagaku Kogyo Co.) and 1 part of aluminum sulfate were added thereto. A sheet was manufactured by using a paper-making machine. A substrate (2) weighting 64 $g/m^2$ was manufactured by coating a 8% aqueous solution of oxidized starch in a coating amount of 1.5 $g/m^2$ on the obtained sheet.

(3) 100 parts of LBKP having a freeness of 350 ml were used as a pulp for the substrate. 10 parts of calcite-group natural (ground) calcium carbonate (amorphous, 50% mean particle size: 4.6 μm, BET-specific area: 3.4 $m^2/g$) and 0.02 part of cationic polyamide (retention-aid), viscosity: 590 c.p. at 0.5% consistency) were added thereto to prepare a stuff. A substrate (3) was manufactured from the obtained stuff by using a paper-making machine.

Recording sheets of Examples 12, 13 and 14 were obtained by applying a coating material in the same manner as in Example 3 on each of the above substrates (1) (2) and (3).

From Table 5 which indicates the test results of the recording sheets, the substrates manufactured in acidic medium or in a neutral medium are used as the substrate of this invention.

TABLE 5

| | Sample | Example 12 | Example 13 | Example 14 |
|---|---|---|---|---|
| Ink receptive layer | Ultra-fine silica A | 100 | 100 | 100 |
| | Polyvinyl alcohol A | 10 | 10 | 10 |
| | Cationic polymer K | 5 | 5 | 5 |
| Coating amount $g/m^2$ | | 2.0 | 2.1 | 2.2 |
| Recording properties | Density of dots | 5.12 | 5.53 | 5.35 |
| | Ozone-resistance % | 9.6 | 8.3 | 6.3 |
| Paper property | Surface strength | A | A | B |

EXAMPLES 15 AND 16

The recording sheets of Examples 15 and 16 were obtained in the same manner as in Example 1 except that cationic polymer B, or C was used instead of a cationic polymer (A) in Example 1.

Cationic polymer B: Polymer of β-methacryloyl oxyethyl trimethyl ammonium chloride

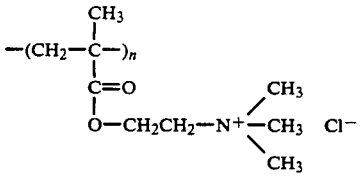

(Molecular weight: 28,000)
Cationic polymer C: methyl glycol chitosan (n = 400 and more)

From Table 6 indicating the test results, various cationic polymers can fit the purpose of this invention.

TABLE 6

| | | Example 1 | Example 15 | Example 16 |
|---|---|---|---|---|
| Ink receptive layer | Ultra-fine silica A | 100 | 100 | 100 |
| | Polyvinyl alcohol | 10 | 10 | 10 |
| | Cationic polymer A | 10 | | |
| | Cationic polymer B | | 10 | |
| | Cationic polymer C | | | 10 |
| Recording properties | Density of dots | 5.42 | 5.50 | 5.62 |
| | Ozone-resistance % | 8.8 | 9.5 | 9.9 |
| Paper property | Surface strength | A | A | A |

A: Polydimethyldiallyl quaternary ammonium salt (Molecular weight: circa 120,000)

B:

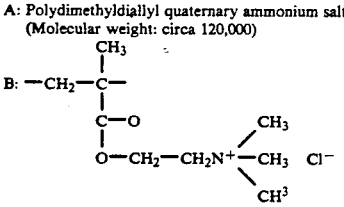

(Molecular weight: circa 280,000)
C: Methyl glycol chitosan

COMPARATIVE EXAMPLES 7, 8 and 9

100 parts of LBKP having 300 Freeness (CSF) as a pulp stuff, 25 parts of ultra-fine anhydrous silica (mean primary particle size: 12 nm, BET-specific surface area: 200 g/m$^2$), parts of a cationic polymer (polydimethyldiallyl quaternary ammonium salt, average molecular weight: 120,000), 0.15 part of fortified rosin sizing agent (Coropal CS, manufactured by Seiko Chemical Co.) and 1 part of aluminum sulfate were mixed. A base sheet having a weight of 64 g/m$^2$ was produced from the mixed stuff by a paper machine, and then it is treated by a supercalender to obtain a recording sheet of Comparative Example 7.

Further, a recording sheet of Comparative Example 8 was obtained in the same manner as in Comparative Example 7, except for using 50 parts of ultra-fine silica A instead of 25 parts of ultra-fine silica A in Comparative Example 7.

Furthermore, a recording sheet of Comparative Example 9 was obtained by coating on the recording sheet of Comparative Example 8 or 6% aqueous solution of polyvinyl alcohol (saponification value: 99% and more, average polymerization degree: 1700) with subsequent drying and supercalender-treating, wherein the aqueous solution of polyvinyl alcohol was coated onto the base sheet in a coating amount of circa 2 g/m$^2$ (as solid content) by a meyer bar.

From Table 7 indicating the test results, the effects of this invention were not obtained by using a substrate comprising both an ultra-fine anhydrous silica and a cationic polymer, or by using the above substrate having thereon a coating layer containing a polyvinyl alcohol binder.

TABLE 7

| | | Example 1 | Comparative Example 7 | Comparative Example 8 | Comparative Example 9 |
|---|---|---|---|---|---|
| Substrate | LBKP | 100 | 100 | 100 | 100 |
| | Kaolin | 10 | | | |
| | Ultra-fine silica A | | 25 | 50 | 50 |
| | Fortified rosin sizing agent | 0.15 | 0.15 | 0.15 | 0.15 |
| | Aluminum sulfate | 1 | 1 | 1 | 1 |
| | Cationic polymer | | 10 | 10 | 10 |
| Ink receptive layer | Ultra-fine silica A | 100 | | | |
| | Polyvinyl alcohol | 10 | | | 100 |
| | Cationic polymer A | 10 | | | |
| Recording properties | Density of dots | 5.42 | 4.70 | 4.72 | 4.87 |
| | Ozone-resistance | 8.8 | 12.5 | 9.5 | 8.9 |
| Paper property | Surface strength | A | C | C | B |

The evaluated quantities of Tables 1–7 were tested as follows.

(1) Color density of dots

Dots are printed on a recording sheet with four color-inks (black, cyan, magenta and yellow) at a certain distance, by the use of sharp color-image printer 10–700. The optical density of each dot is measured by using a Microdensitometer (PDM 5B.BR manufactured by KONISHIROKU PHOTO IND. CO., LTD.), wherein the test conditions is as follows:

an integrated magnification: 20, a slit breadth: 2.5 μm, slit height: 25 μm, stage velocity: 25 μm/sec. The respective density of the four colors is summed up, and given in Tables. The recording sheet having a total density of 5 and more is evaluated as "good".

(2) Preservability (Ozone-resistance)

A recording sheet is printed with black ink used for an Canon ink jet printer PJ-1080A by using a Bristow equipment (contact time: 0.01 sec., ink amount: circa 20 ml/m$^2$). The printed sheet is charged into a desiccator having 20 ml volume. Ozone of 0.0003 g/min. from ozone-generator IOP-O (manufactured by Simon Co.), together with a certain amount of air, is passed through this desiccator.

After ozone treatment during 10 min., the color-difference of the printed portion is measured before and after the ozone treatment. The fading percentage is calculated by the following formula, whereby ozone-resistance is evaluated.

The recording sheet having a fading percentage of 10 and less is evaluated as "good".

Color-difference between unprinted and printed portions before ozone-treatment: $D_0$ Color-difference between unprinted and printed portions after ozone-treatment: $D_1$ Ozone-resistance (Fading percentage): $D_s$ $$D_s = D_1/D_0 \times 100\%$$

(3) Light resistance

A recording sheet is printed with magenta ink by using a Bristow equipment (contact time: 0.01 sec., ink amount: circa 20 ml/m$^2$). The printed sheet is treated with fading equipment (Model BH, use of carbon arc lamp, manufactured by Toyo Seiki Co.) for 40 hours. The color-difference of the printed portions before and after the treatment is measured. Fading percentage is calculated by the following formula, wherein the light resistance is evaluated. The recording sheet having a light resistance of 10 and less is evaluated as "good".

Color-difference between unprinted and printed portions: $F_0$

Color-difference of the printed portions before and after the fading-treatment: $F_s$ Light resistance (Fading percentage): $F_s$ $$F_s = \frac{F_1}{F_0} \times 100\%$$

(4) Surface strength

A cellophane-tape of 15 cm length is uniformly adhered onto a recording sheet by applying a constant pressure. After 15 minutes, the tape is peeled off from the sheet with a certain velocity. The peeled state is evaluated by eyes as follows.

A: the coating material of the recording sheet is hardly observed on the tape.

B: the coating material of the recording sheet is observed on some surface of the tape.

C: the coating material of the recording sheet is observed on the whole surface of the tape.

The recording sheet having "A" and "B" is evaluated as "good".

As described above, the application of the coating material (ink-receptive layer) comprising both an ultra-fine anhydrous silica and a cationic polymer on a substrate provides a recording sheet which exhibits an uniform image quality, a high recording density, a good mult-color recording property and a slight fading of the image by oxidizing gases, under maintaining the paper-like figure and feeling.

Further, the recording sheet of this invention is economically advantageous owing to a small amount of the coating material for obtaining the above features.

We claim:

1. An ink-jet recording sheet for providing an image by the use of an aqueous ink containing a water-soluble dye, which comprises an ink-receptive layer of a coating material comprising both an ultra-fine anhydrous silica and a cationic polymer, coated on an ink-absorptive substrate in an amount of no more than 10 g/m$^2$.

2. The ink jet recording sheet according to claim 1, wherein said ultra-fine anhydrous silica has a high $SiO_2$ content and no internal surface, and is in the form of an aggregate of spherical particles having a mean primary particle size of 7–40 m$\mu$.

3. The ink jet recording sheet according to claim 1, wherein said cationic polymer is at least one polymer selected from the group consisting of polyethylene imine, polydimethyldiallyl ammonium chloride, polyalkylene-polyamine dicyandiamide ammonium condensate, polyvinylpyridinium polymers of (meth) acryloyl oxyalky quaternary ammonium salt, polymers of (meth)acrylamide alkyl quaternary ammonium salts, $\omega$-chloropoly (oxyethylene-polymethylene-alkyl quaternary ammonium salts), methyl glycol chitosan and polyvinyl benzyl trimethyl ammonium salt.

4. The ink jet recording sheet according to claim 1, wherein said cationic polymer is polydimethyl-diallyl ammonium chloride, a polymer of (meth)acryloyl oxyalkyl quaternary ammonium salt, a polymer of (meth)acrylamide alkyl quaternary ammonium salt, $\omega$-chloropoly (oxyethylene-polymethylene-alkyl quaternary ammonium salt) or methylglycol chitosan.

5. The ink jet recording sheet according to claim 1, wherein said cationic polymer is used in an amount of 0.2–20 weight-parts, based on 100 weight-parts of said ultra-fine anhydrous silica.

6. The ink jet recording sheet according to claim 1, wherein said ink receptive layer comprises further a binder having little reactivity with said cationic polymer.

* * * * *

UNITED STATES PATENT AND TRADEMARK OFFICE

CERTIFICATE OF CORRECTION

PATENT NO. : 5,165,973

DATED : November 24, 1992

INVENTOR(S) : Yutaka Kojima and Takashi Omori

It is certified that error appears in the above-identified patent and that said Letters Patent is hereby corrected as shown below:

Column 3, line 46, change "7-40 mμ" to --7-40 nm--.

Column 6, line 25, change "12 μm" to --12 nm--.

Column 8, line 67, change "18 μm" to --18 nm--.

Column 9, line 1, change "16 μm" to --16 nm--;

lines 2-3 , change "7 μm" to --7 nm--;

line 5, change "30 μm" to --30 nm--.

IN THE CLAIMS:

Claim 2, column 14, line 25, change "7-40 mμ" to --7-40 nm--.

Signed and Sealed this

Seventh Day of December, 1993

*Attest:*

Bruce Lehman

BRUCE LEHMAN

*Attesting Officer*

*Commissioner of Patents and Trademarks*